US005375538A

United States Patent [19]

Goussu et al.

[11] Patent Number: 5,375,538

[45] Date of Patent: Dec. 27, 1994

[54] BOILER HAVING A FLUE GAS RECYCLING CIRCUIT

[75] Inventors: Bernard Goussu; Samuel Thobois, both of Guyancourt, France

[73] Assignee: Stein Industrie, Velizy-Villacoublay, France

[21] Appl. No.: 991,542

[22] Filed: Dec. 15, 1992

[30] Foreign Application Priority Data

Dec. 18, 1991 [FR] France ..... 91 15732

[51] Int. Cl.[5] ..... F23C 9/00; F22B 21/38

[52] U.S. Cl. ..... 110/234; 110/204; 110/165 R; 122/479.2

[58] Field of Search ..... 110/234, 171, 204, 297, 110/165 R; 122/479.2

[56] References Cited

U.S. PATENT DOCUMENTS 423,518 3/1890 Hurst ..... 110/234
2,840,054 6/1958 Rowand ..... 122/479.2
2,985,152 5/1961 Paulison, Jr. ..... 122/479
3,090,332 5/1963 Burbach et al. ..... 110/49
4,494,468 1/1985 Rickard ..... 110/234

FOREIGN PATENT DOCUMENTS 747219 3/1956 United Kingdom ..... 122/479

*Primary Examiner*—Henry A. Bennett
*Assistant Examiner*—William C. Doerrler
*Attorney, Agent, or Firm*—Sughrue, Mion, Zinn, Macpeak & Seas

[57] ABSTRACT

A boiler having vertical walls of large size constituted by screens of heat exchanger tubes, fitted with a flue gas recycling circuit, and including a prismatic bottom portion referred to as an "ash box". The recycled combustion gases are fed via at least one duct that opens out into one of the end walls of a hopper disposed beneath the ash box.

4 Claims, 2 Drawing Sheets

BOILER HAVING A FLUE GAS RECYCLING CIRCUIT

The present invention relates to a high power boiler having a gas recycling circuit.

More precisely, it relates to a boiler having vertical walls of large size constituted by screens of heat-exchange tubes, fitted with a flue gas recycling circuit, and including a prismatic bottom portion referred to as an "ash box".

BACKGROUND OF THE INVENTION

In conventional manner, such boilers are fitted with burners associated with air feed means, said burners being optionally tiltable. Boilers are adjusted firstly by adjusting the flow rate of recycled gas, so as to increase the flow of flue gas in the boiler and increase heat exchange with equipment that operates in convection, and secondly by changing the level of the fire by means of the tiltable burners which act on equipment that works by radiation. Using these two means, it is possible to adjust the superheating and re-superheating absorption by an appropriate disposition of equipment in the hearth.

In known boilers, the recycled gases are conveyed by ducts which pass through the lateral screens of the boiler. This prior art is illustrated by American patents U.S. Pat. Nos. 3,090,332 and 2,985,152.

More precisely, with boilers burning fuel oil, these ducts are connected in substantially horizontal manner to one of the slopes of the ash box (where the slopes are screens of heat exchanger tubes that slope downwards and inwards at the bottom of the boiler to form the ash box).

For a boiler that burns coal or a mixture of coal and fuel oil, these horizontal ducts open out into the screen that forms one of the side faces of a clinker-removing ash hopper disposed beneath the ash box.

It is important to obtain good uniformity in the gases recycled through the boiler in order to avoid disturbing the combustion vortex established level with the burners.

That is why it is essential to install a plurality of ducts feeding recycled gases to any one side face, there being up to four ducts for a large hearth. Unfortunately making the openings through the screens of heat exchanger tubes requires operations that are relatively complex, in particular for so-called "spiral" tube screens, and arrangements for ensuring tube continuity. Furthermore, when of large dimensions, these openings have bottom points that cannot be emptied.

In addition, with such a lateral disposition of recycled gas feed ducts, it is never possible to install the ducts in a rational configuration because of the equipment (in particular the manifolds and the feed tubes extending the screens of heat exchanger tubes) that are always present and that take up a large amount of room on the sides of the boiler, and that necessarily require the recycling ducts and the heat exchanger tubes to be diverted and special gaskets to be installed, which operations are particularly expensive.

Finally, when burning coal, there is always the problem of ash accumulating at the outlets of the recycled gas feed ducts, even in boilers having an ash hopper, since the ducts are horizontal where they open out into the hopper.

SUMMARY OF THE INVENTION

The invention solves these problems by feeding the recycled combustion gases via at least one duct that opens out into one of the end walls of a hopper disposed beneath the ash box.

Thus, using one or two ducts, a uniform mixture of gases is obtained in the hearth and the recycled gases do not disturb the combustion vortex. This is achieved in particular because of the trench constituted by the hopper in which the gases are diluted freely on the axis of the hearth.

Preferably, in order to improve the uniformity of the gases, each of the end walls is provided with a recycled gas feed duct.

In addition, this disposition makes it possible to avoid problems of space availability on the sides of the boiler, and in order to avoid any danger of the ducts filling with coal ash, each duct should, at least in part, slope downwards close to its outlet into the hopper with its lowest point being disposed in said outlet.

This disposition for feeding recycled gases is applicable to any boiler burning fuel oil only or a mixture of fuel oil and solid fuel, and regardless of whether the heat exchangers screens have vertical tubes or "spiral" tubes.

BRIEF DESCRIPTION OF THE DRAWING

The invention is described by way of example with reference to the accompanying drawing which shows two preferred embodiments of the invention.

DETAILED DESCRIPTION

Figure 1:
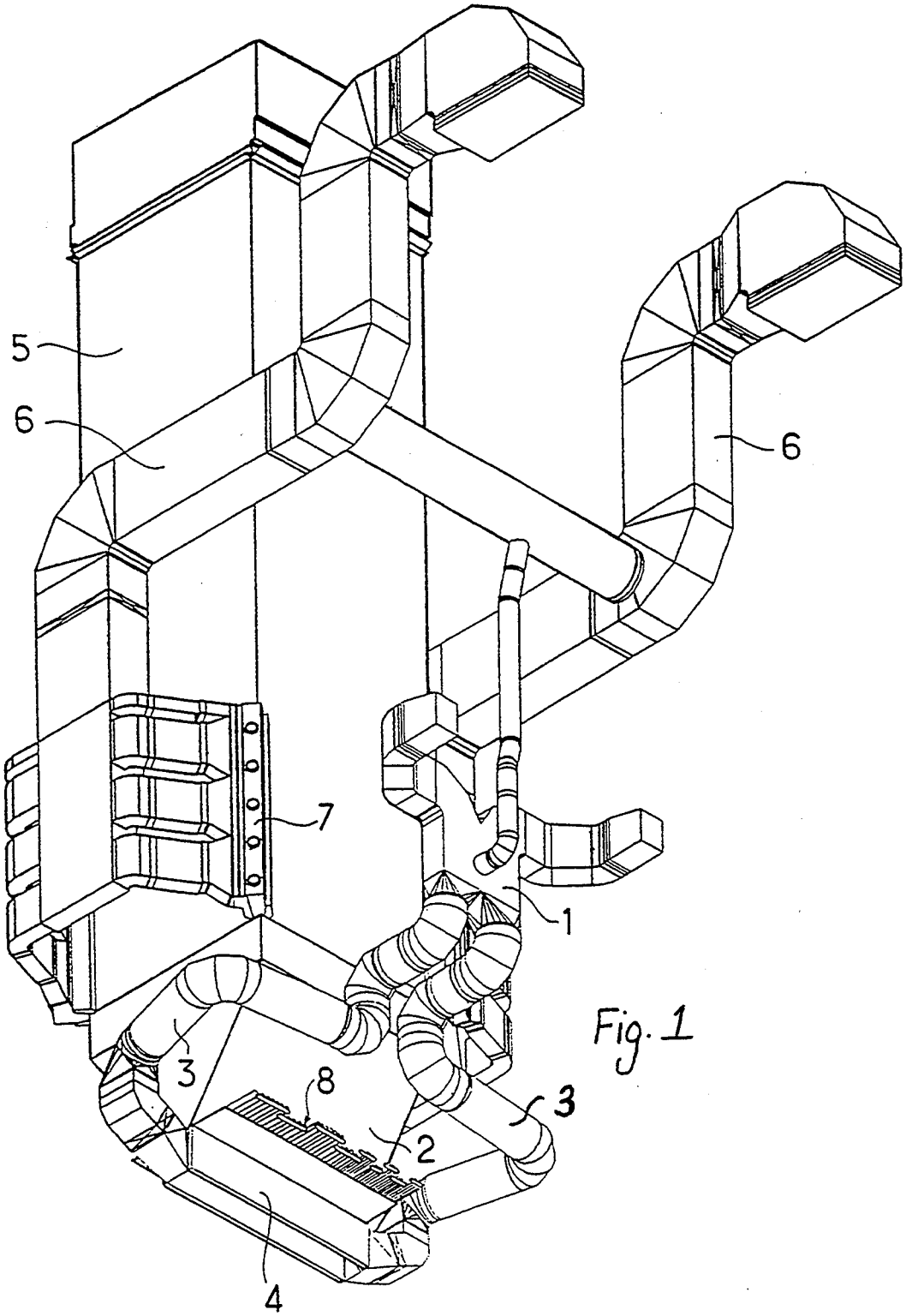
FIG. 1 is a fragmentary perspective view of a boiler in accordance with a first embodiment of the invention.

The boiler has vertical walls 5 of large size constituted by heat exchanger tubes fed by manifolds and tubes 8. Secondary air feed ducts 6 feed said air to burners 7 disposed on the "side" walls 5 of the boiler.

The boiler is fitted with a circuit 1 for recycling flue gas, and at its bottom end it includes a prismatic portion 2 referred to as the "ash box" and provided with a hopper 4 into which the recycled combustion gases are fed by means of two ducts 3,3 that open out into "end" walls of the hopper 4. Each duct 3 slopes downwards in the vicinity of its outlet into the hopper 4, with its lowest point being disposed at said outlet.

Tests have shown that the recycled flue gas flows horizontally in the "trench" constituted by the hopper 4, with the flows meeting on the longitudinal vertically extending axis of the boiler and rising into the combustion vortex, after which they flow with the lateral recirculation movements. Above the ash box 2, and starting from the first burner level 7, the vortex becomes large and the recycled flue gas is mixed very uniformly with the combustion flue gas.

Figure 2:
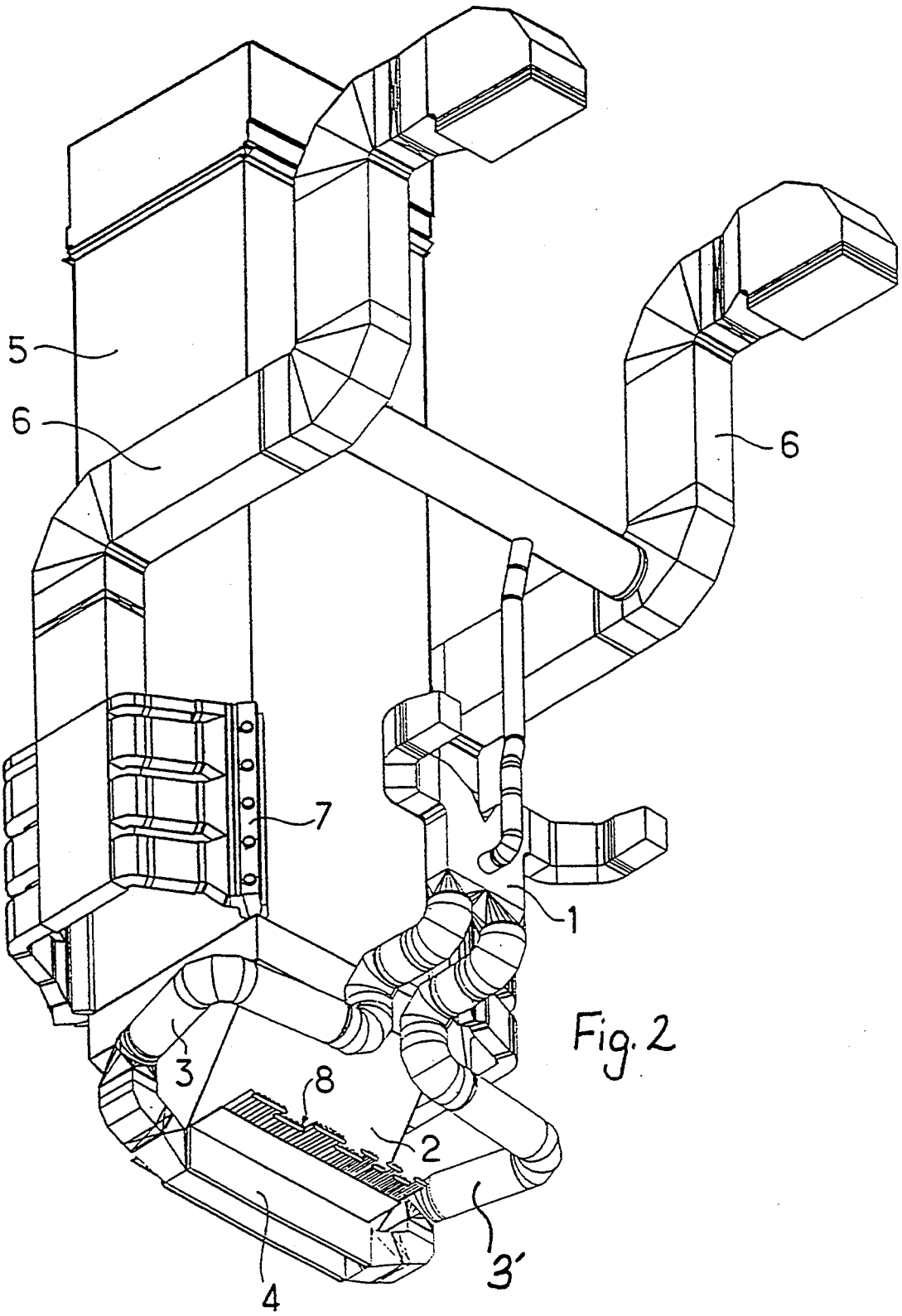
FIG. 2 is a fragmentary perspective view of a boiler in accordance with a second embodiment of the invention.

As shown in FIG. 2, the boiler may have only one recycled gas feed duct 3', in which case the flue gas runs horizontally along the entire length of the hopper 4 and rises along its wall, mixing in the ash box 2 prior to rising into the combustion vortex.

It is particularly clear in the FIGS. 1 and 2 that this disposition makes it possible to avoid problems of availability of lateral room adjacent to the boiler, and the ducts 3' can be installed rationally without interacting with the manifolds and the feed tubes 8 that extend the screens of heat exchanger tubes.

We claim:

1. In a boiler having vertical walls of large size constituted by vertically extending lateral screens of heat exchanger tubes, fitted with a flue gas recycling circuit, and including a prismatic bottom portion constituting an ash box, the improvement comprising: a horizontally extending hopper mounted to the bottom of said ash box and having first and second vertically extending opposed end walls; and only one recycled gas feed duct, said duct opening out directly into only said first end wall of said hopper, without passing through said lateral screens, such that the hopper acts as a trench beneath the ash box for horizontal recycled flue gas flow which rises therefrom through said ash box into a combustion vortex within said boiler.

2. In a boiler having vertical walls of large size constituted by vertically extending lateral screens of heat exchanger tubes, fitted with a flue gas recycling circuit, and including a prismatic bottom portion constituting an ash box, the improvement comprising: a horizontally extending hopper mounted to the bottom of said ash box and having first and second vertically extending opposed end walls; and only first and second recycled gas feed ducts, said first recycled gas feed duct opening out directly into only said first end wall of said hopper, and said second recycled gas duct opening out directly into only said second end wall without passing through said lateral screens, thereby providing only two recycled gas feed ducts opening out into only said first and second end walls, respectively, with flows from opposite ends of said hopper meeting on a vertical axis of the boiler and rising through said ash box into said combustion vortex.

3. A boiler according to claim 2, wherein at least a portion of each recycled gas feed duct slopes downwards in the vicinity of its opening into the hopper, with its lowest point being disposed in said opening.

4. A boiler according to claim 1, wherein at least a portion of said recycled gas feed duct slopes downwards in the vicinity of its opening into the hopper, with its lowest point being disposed in said opening.

* * * * *